US010995960B2

(12) United States Patent
Luckhardt et al.

(10) Patent No.: US 10,995,960 B2
(45) Date of Patent: May 4, 2021

(54) FOOD PREPARATION ENTITY

(71) Applicant: ELECTROLUX APPLIANCES AKTIEBOLAG, Stockholm (SE)

(72) Inventors: Christoph Luckhardt, Rothenberg ob der Tauber (DE); Fabienne Reinhard-Herrscher, Schnelldorf (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 154 days.

(21) Appl. No.: 16/468,836

(22) PCT Filed: Nov. 20, 2017

(86) PCT No.: PCT/EP2017/079816

§ 371 (c)(1),
(2) Date: Jun. 12, 2019

(87) PCT Pub. No.: WO2018/114170

PCT Pub. Date: Jun. 28, 2018

(65) Prior Publication Data

US 2020/0072471 A1 Mar. 5, 2020

(30) Foreign Application Priority Data

Dec. 21, 2016 (EP) ..... 16206001

(51) Int. Cl.
*G06K 9/00* (2006.01)
*F24C 7/08* (2006.01)
(Continued)

(52) U.S. Cl.
CPC ..... *F24C 7/085* (2013.01); *G06K 9/60* (2013.01); *G06K 9/6298* (2013.01)

(58) Field of Classification Search
CPC ..... F24C 7/085; G06K 9/60; G06K 9/6298; G06K 9/00671; G09B 19/0092; A47J 36/321; G01N 33/02; G06Q 50/12
(Continued)

(56) References Cited

U.S. PATENT DOCUMENTS 8,578,293 B2 * 11/2013 Breunig ..... G05B 19/0426 715/812
9,576,034 B2 * 2/2017 Kamei ..... G06Q 50/12
(Continued)

FOREIGN PATENT DOCUMENTS

DE 102012204229 A1 9/2013
EP 2662628 11/2013
(Continued)

OTHER PUBLICATIONS

International Search Report and Written Opinion iin PCT/EP2017/079816 dated Feb. 13, 2018, 10 pages.
(Continued)

*Primary Examiner* — Mahendra R Patel
(74) *Attorney, Agent, or Firm* — Pearne & Gordon LLP

(57) ABSTRACT

The invention relates to a food preparation entity comprising a cavity (2) for receiving food to be prepared and an image recognition system (3) for gathering optical information of the food to be prepared, wherein the food preparation entity (1) is further adapted to store, gather and/or receive meta-information and select one or more food types out of a list of food types based on said meta-information and said captured optical information.

18 Claims, 2 Drawing Sheets

(51) Int. Cl.
*G06K 9/60* (2006.01)
*G06K 9/62* (2006.01)

(58) Field of Classification Search
USPC ..... 382/100
See application file for complete search history.

(56) References Cited

U.S. PATENT DOCUMENTS 9,721,008 B1 * 8/2017 Byron ..... G06F 40/284
10,262,302 B2 * 4/2019 Kim ..... G06Q 10/1097
10,657,577 B2 * 5/2020 Sundaram ..... G06Q 10/087
2005/0192869 A1 * 9/2005 Maeda ..... G06Q 30/0601 705/26.1
2005/0241492 A1 * 11/2005 Kooyker ..... A47J 37/12 99/403
2013/0273509 A1 * 10/2013 Mutti ..... G09B 19/0092 434/127
2016/0150213 A1 * 5/2016 Mutti ..... G06K 9/4604 348/143
2016/0327281 A1 * 11/2016 Bhogal ..... F24C 3/124
2016/0350715 A1 * 12/2016 Minvielle ..... G01N 33/02
2017/0020332 A1 * 1/2017 Strang ..... G06F 1/163
2018/0084941 A1 * 3/2018 Noth ..... B65D 85/8046

FOREIGN PATENT DOCUMENTS

EP 2977683 A1 1/2016
WO WO-03107233 A1 * 12/2003 ..... G06Q 30/02
WO WO-2014160298 A1 * 10/2014 ..... G06T 7/0002

OTHER PUBLICATIONS

EP Office action for application No. 16206001.6 dated Feb. 11, 2020.

* cited by examiner

FOOD PREPARATION ENTITY

BACKGROUND OF THE INVENTION

Food preparation entities, for example baking ovens, are well known in prior art. Such food preparation entities may comprise an image recognition system for capturing optical information for selecting a certain food type based on said optical information. More in detail, the captured optical information may be compared with stored information in order to decide which food type is most probably included in the cavity.

However in cases in which the visual appearance of food types is quite similar, the selection quality is quite low.

SUMMARY OF THE INVENTION

It is an objective of embodiments of the present invention to provide a food preparation entity with improved food type selection properties. If not explicitly indicated otherwise, embodiments of the invention can be be freely combined with each other.

According to an aspect, the invention relates to a food preparation entity. Said food preparation entity comprises a cavity for receiving food to be prepared and an image recognition system for capturing optical information of the food to be prepared. The food preparation entity is further adapted to store, gather and/or receive meta-information and select one or more food types out of a list of food types based on said meta-information and said captured optical information. So, in other words, the food preparation entity does not recognize the foodstuff or dish solely based on comparing the optical information with known optical information of certain foodstuff but additionally includes meta-information in order to enhance the detection accuracy, increase the detection speed and enable plausibility checks.

According to preferred embodiments, the food preparation entity comprises a processing entity adapted to perform a food preselection based on the captured optical information in order to determine a subset of possible food types which may be received within the cavity, wherein the food preparation entity is further adapted to select one or more food types out of the subset of possible food types based on said meta information. So, in other words, the food preparation entity uses a two-stage procedure for selecting one or more food types out of a given set of food types wherein meta-information are used in a second step to refine or check plausibility of the choice made during a first step using said optical information provided by the image recognition system.

According to preferred embodiments, the food preparation entity is adapted to store, gather and/or receive geographical information and the food preparation entity is further adapted to select one or more food types out of the subset of possible food types based on said geographical information. By using geographical information, specifically location information at which the food preparation entity is installed, food types can be prioritized which are typically consumed at that location.

According to preferred embodiments, the food preparation entity is adapted to associate each food included in the subset of possible food types with a weighting factor, said weighting factor depending on the geographical information and indicating the frequency of consumption of said food in a geographical region characterized by said geographical information. Thereby it is possible to perform a weighting of preselected food types (preselected by using optical information) based on said geographical information. Alternative or additional information may be gathered as to seasonal food in relation to graphical information for influencing the weighting factor, in particular accommodating the fact that such seasonal food ingested at one and the same point in time differs from the location of ingestion situated either on the northern or the southern hemisphere.

According to preferred embodiments, said meta-information comprises information regarding the user operating the food preparation entity. For example, user information can be obtained by menu based user selection, near field communication methods, finger print sensors or other user recognition/detection technologies. Different users may have different cooking behaviour and certain food preferences. Therefore, information of the cur rent user is advantageous for improving the detection results.

According to preferred embodiments, the food preparation entity is adapted to store or access a list of food types associated with a certain user and adapted to select one or more food types out of the subset of possible food types based on information of the user operating the food preparation entity and the list of food types associated with the respective user. Said list may be, for example, continuously updated based on the user's cooking behaviour. By having knowledge of the current user of the food preparation entity and having access to the list comprising food preferences of the respective users, detection results and detection speed can be significantly improved.

According to preferred embodiments, said meta-information comprises information regarding the present time, date and/or season. Such temporal information can be indicative for certain kind of food types because, for example, a certain food is typically cooked during the winter season, whereas another food is typically cooked during summer time. Therefore, by including w temporal information, the detection results and detection speed can be significantly improved.

According to preferred embodiments, the food preparation entity is adapted to store or access a list of time-dependent food types, each food type of said list being associated with a certain temporal information, wherein said food preparation entity is adapted to select one or more food types out of the subset of Possible food types based on information regarding the present time, date and/or season and said list of time-dependent food types. In other words, the list includes information regarding the consumption of certain food at a given time or time period. Based on said information and the present time it is possible to derive information regarding the probability that a certain food type is currently cooked.

According to preferred embodiments, the food preparation entity is adapted to provide a list of food types with multiple estimated food type entries ranked according to a ranking scheme based on said optical information of food to be prepared and said meta-information, said ranking being performed according to the probability that the respective estimated food type matches the food received within the cavity. So, the food preparation entity does not provide a single food type recognition result but Provides multiple recognition results. The recognition results may be displayed at a graphical user interface of the food preparation entity.

According to preferred embodiments, the list of food types is sorted according to the probability that the respective estimated food type matches the food received within the cavity. In other words, the list of food types is sorted according to relevance. Thereby it is possible to enhance the usability of the food preparation entity.

According to preferred embodiments, multiple meta-information is combined for selecting one or more food types out of the subset of possible food types. So, for example by combining location information and temporal information it is possible to determine whether it is winter time or summer time (which may be different in the northern or southern hemisphere) thereby being able to prioritize seasonal foodstuff.

According to preferred embodiments, a machine-learning algorithm, specifically a deep learning algorithm is used for selecting one or more food types. So, in other words, there is not a predefined, fixed selection scheme but the selection scheme is continuously adapted, which further improves the selection quality.

According to preferred embodiments, one or more food preparation programs or one or more food preparation parameters are suggested for the selected one or more food types. Based on the food type selection result, it may be, for example, possible to suggest one or more food preparation programs to the user which are advantageous for cooking the respective food.

According to preferred embodiments, the food preparation entity is adapted to communicate with one or more appliances in order to receive information from said one or more appliances, the food preparation entity being further adapted to process said received information for defining one or more food preparation process parameters. For example, the food preparation entity may be coupled with said further appliances via a wired or wireless communication network. Via said communication network, information can be exchanged which can be used for defining the food preparation process and/or as meta-information for uppermentioned food type recognition process.

According to a further aspect, the invention relates to a method for automatically selecting one or more food types in a food preparation entity, the food preparation entity comprising a cavity for receiving food to be prepared and an image recognition system for capturing optical information of food to be prepared. The method comprises the steps of:

capturing optical information of food received within the cavity;

receiving meta-information; and selecting one or more types of food out of a list of possible types of food based on said captured optical information and said meta information.

The term "food preparation entity" as used in the present disclosure may refer to any appliance which can be used for preparing food, specifically ovens, steam ovens, microwave ovens or similar frying, baking or cooking appliances.

The term "food type" as used in the present disclosure may refer to a certain kind of food or dish, for example, a certain cake or pie (e.g. apple pie), a certain roast (pork, beef, poultry), pizza etc. However, the term "food type" can also refer to a certain class of food, wherein such classes of food can be, for example, cake, roast, vegetables, gratin, etc.

The term "essentially" or "approximately" as used in the present disclosure means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
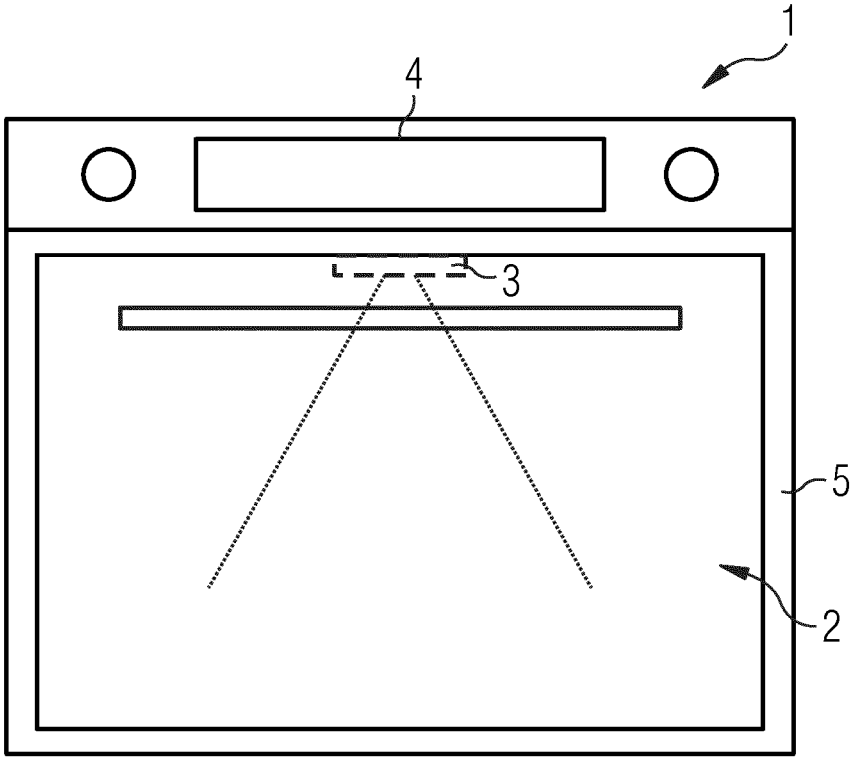
FIG. 1 shows an example schematic view of a food preparation entity.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 shows a schematic illustration of a food preparation entity 1. In the present example, the food preparation entity 1 is a baking oven. The food preparation entity 1 comprises a base body in which a cavity 2 for receiving food to be prepared is provided. The food preparation entity 1 may comprise a door 5 for closing the cavity 2 during the food preparation process. In addition, the food preparation entity 1 may comprise an image capturing system 3. The image capturing system 3 may be, for example, a camera, specifically a digital camera adapted to capture optical information of the food received within the cavity 2. Said optical, information may be one or more digital images or a video sequence. According to embodiments, multiple image capturing systems 3 placed at different locations within the cavity 2 and/or at the door 5 may be used for capturing optical information. In addition, the food preparation entity 1 may comprise a graphical user interface 4 for providing information to the user of the food preparation entity 1 and/or for receiving information from said user.

Figure 2:
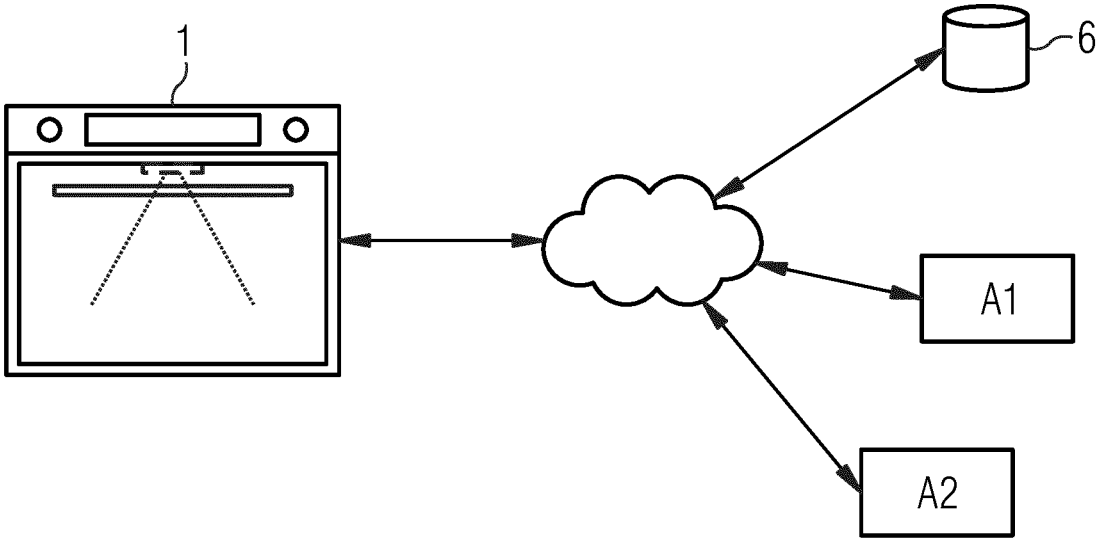
FIG. 2 shows a schematic diagram of a food preparation entity being connected with several appliances and a storage via a communication network.

The food preparation entity 1 may be adapted to select one or more food types out of a list of food types based on said optical information provided by the image capturing system 3. As shown in FIG. 2, the food preparation entity 1 may comprise or may have access to a storage 6 providing said list of food types which are associated with certain food type information which can be used for food type detection. Said list may comprise a plurality of list entries, each list entry associated with a certain food type. The storage 6 may be an internal storage of the food preparation entity 1 or may be an external storage. The food preparation entity 1 may be coupled with said external storage using wired or wireless coupling technologies. The food preparation entity 1 may have access to said external storage via a communication network, specifically the Internet. So, the external storage may be provided as a network-located storage for a plurality of food preparation entities 1 which have access to said external storage via network communication technologies (e.g. IP-based technologies).

Only based on optical information provided by the image capturing system 3 it may be difficult to evaluate the plausibility of the recognition result, i.e. determine if the food recognition system which receives said optical information chooses the right food type. For example, the optical information given by a quiche, an apple pie and a pizza with lots of cheese may be quite similar.

In order to enhance the decision accuracy and to fasten the recognition process, the food preparation entity 1 may additionally use meta-information.

Meta-information according to the present invention may be any information which is suitable for enhancing/fastening the decision process. For example, meta-information may be geographical information, e.g. city, region, country etc., user information or temporal information (e.g. time, date and/or seasonal information etc.).

Said meta-information may be gained in different ways. For example, geographical information can be gained by evaluating settings of the food preparation entity 1, e.g. language or regional settings to be entered at the food preparation entity 1 during an installation routine. However, geographical information can also be gained using the IP-address of the food preparation entity 1, GPS information or any other location information available at the food preparation entity 1.

Similarly, temporal information can also be derived based on time/date settings entered during an installation routine or based on time/date information received via a communication network in which the food preparation entity 1 is included.

User information may be derived by any known user identification routines, for example, by user selection at the graphical user interface 4, a finger print sensor, near field communication technologies (e.g. RFID) based on which a certain user can be identified, etc.

By combining the optical information provided by the image capturing system 3 with such meta-information, the recognition accuracy can be significantly increased because based on said meta-information a plausibility check can be performed and recognition results with lower matching probability can be excluded or associated with a lower matching factor.

For example, meta-information comprising geographical information can be used for selecting/prioritizing food types which are typically consumed in the respective region, e.g. German food types in Germany and Turkish food types in Turkey etc. However, also language settings may be used for prioritizing certain food types because the food preparation entity 1 may be used by a foreigner in the respective country, which may have certain food preferences different to food preferences of natives.

Similarly, user information may be used for selecting/prioritizing food types. Different user may comprise different food preferences. For example, a certain user may often cook pizza whereas another user may prefer quiche. So, including user information in the selection process may lead to improved food recognition results.

Also time, date and/or seasonal information may be used for selecting/prioritizing food types. For example, roasted food may be more often consumed during the winter season. Similarly, seasonal vegetables may be more often used in a limited period of time during their respective season. Therefore, including time, date and/or seasonal information in the selection process may also improve food recognition.

According to preferred embodiments, multiple different meta-information may be used for selecting/prioritizing food types. For example, geographical information and user information may be used to improve food recognition.

Said food type selection process may be performed by a processing entity within the food preparation entity 1, for example a computing entity, specifically a microprocessor or an embedded computer. The food type selection process may use a machine learning algorithm, specifically a deep learning algorithm adapted to learn from previous data and predict future data based on information derived from said previous data.

Said selection/prioritizing of food types may be performed using multiple steps. In a first step, a food type preselection may be performed. For example, based on the captured optical information, a subset of possible food types may be selected which best suit the food received in the cavity 2. In a further step, meta-information is included and by considering optical information and meta-information, one or more food types of said preselected food types may be selected.

According to an embodiment, the food preparation entity 1 may select a single food based on optical information and meta-information. The food preparation entity 1 may use a best-fitting algorithm, i.e. may decide based on optical information and meta-information which food fits best to received optical information and available meta-information.

According to other embodiments, multiple food types (i.e. different kinds of food) may be selected. Said multiple food types may, for example, be provided to the user at a graphical user interface 4. For example, said multiple food types may be provided in a sorted list, said sorting being performed top-down based on a probability value defining the probability according to which the selected food type matches the food received in the cavity 2. In other words, the list comprises as a first list entry a food type which may fit best to the food received in the food preparation entity 1 and is followed by further food entries which have lower matching probabilities. So, the list may be sorted based on the match probability in a descending order.

By considering the one or more selected food types it is possible to enhance the usability of the food preparation entity 1. For example, it may be possible to suggest one or more food preparation programs (e.g. certain heating mode, certain temperature selection etc.). Alternatively, it may be possible to suggest only certain parameters for a food preparation process, e.g. a recommended temperature value or temperature range. In addition, based on the recognized food type it may be possible to further improve a monitoring process performed during food preparation. By having knowledge of the food received within the cavity, an improved hint or instruction can be provided to the user, e.g. regarding when a certain food preparation process should be stopped.

As further shown in FIG. 2, the food preparation entity 1 may be coupled with further appliances A1, A2 via a wired or wireless communication network. Further meta-information may be received from said further appliances A1, A2. Said meta-information may be used at the food preparation entity 1 for upper-mentioned food selection process. E.g. geographic information, user information and/or time information may be provided from said further appliances A1, A2 to the food preparation entity 1 which are considered in upper-mentioned food selection process. However, also information can be exchanged which may be considered in other automatic processes of the food preparation entity 1. For example, an environmental temperature value may be provided by said further appliances A1, A2 and the food preparation entity 1 may use said temperature value as starting temperature for auto-cooking functions.

Figure 3:
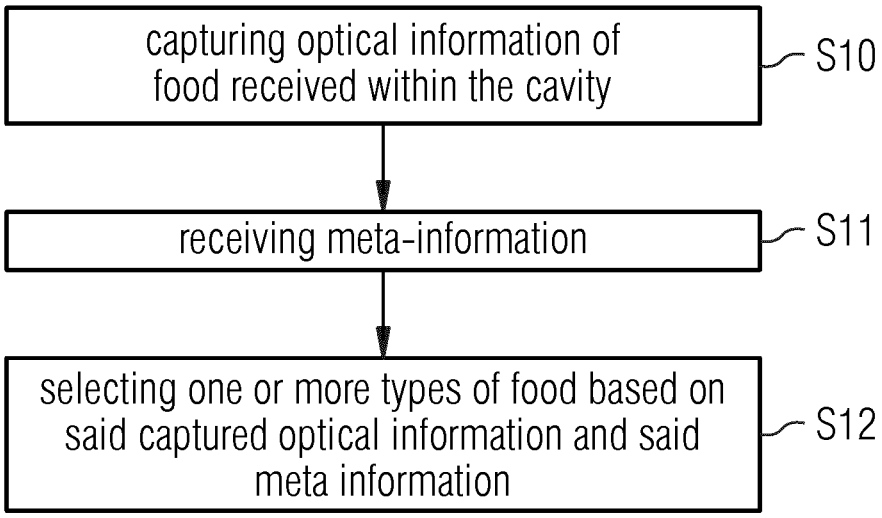
FIG. 3 shows a flow diagram of a method for automatically selecting food types.

FIG. 3 shows a schematic flow diagram illustrating steps performed in a method for automatically selecting one or more food types by a food preparation entity 1. As already mentioned above, the food preparation entity 1 may comprise or may have access to a storage in which information regarding food types is stored. The aim of the food type selection process is to select one or more food types which come closest to the food received within the oven cavity.

As a first step, optical information of the food received within the oven cavity may be captured (S10). Based on said optical information, a preselection may be performed. In other words, food types included in the set of stored food types may be excluded which does not fit to the captured optical information at all.

In addition, meta-information may be received (S11). Said meta information may be used for selecting one or more food types out of a list including the preselected food types (S12). In other words, based on said received meta-information, a plausibility check may be performed. For example, captured optical information indicates that the food received within the cavity 2 can be a pizza or an apple pie with nearly the same probability. Then, based on meta-information, that a child is using the food preparation entity 1, there is a higher probability that a pizza is received within the cavity 2.

It should be noted that the description and drawings merely illustrate the principles of the proposed food preparation entity. Those skilled in the art will be able to implement various arrangements that, although not explicitly described or shown herein, embody the principles of the invention.

LIST OF REFERENCE NUMERALS

1 Food preparation entity
2 cavity
3 image capturing system
4 graphical user interface
5 door
6 storage
A1, A2 further appliance

The invention claimed is:

1. Food preparation entity having a user interface and comprising a cavity for receiving food to be prepared, an image recognition system for capturing optical information of the food to be prepared, and a processing entity adapted to perform a food preselection based on the captured optical information in order to determine a subset of available food types, wherein the food preparation entity is further adapted to store, gather and/or receive meta-information associated with said optical information and to select via a machine-learning algorithm one or more of said food types out of a list of the available food types based on said meta-information and said captured optical information, wherein said meta-information associated with the optical information comprises one or more of the following: geographical information, user information, temporal information.

2. Food preparation entity according to claim 1, said meta-information comprising geographical information, the food preparation entity being adapted to select said one or more food types out of the subset of available food types based on said geographical information.

3. Food preparation entity according to claim 1, adapted to associate each food included in the subset of available food types with a weighting factor, said weighting factor depending on geographical information and indicating a frequency of consumption of said food in a geographical region characterized by said geographical information.

4. Food preparation entity according to claim 1, wherein said meta-information comprises information regarding a user who is operating the food preparation entity.

5. Food preparation entity according to claim 3, adapted to store or access a list of food types associated with a certain user and adapted to select one or more food types out of the subset of available food types based on information of the user operating the food preparation entity and the list of food types associated with the respective user.

6. Food preparation entity according to claim 1, wherein said meta-information comprises information regarding a present time, date and/or season.

7. Food preparation entity according to claim 6, adapted to store or access a list of time-dependent food types, each food type of said list of time-dependent food types being associated with a certain temporal information, wherein said food preparation entity is adapted to select one or more food types out of the subset of available food types based on information regarding a present time, date and/or season and said list of time-dependent food types.

8. Food preparation entity according to claim 1, adapted to provide a list of food types with multiple estimated food type entries ranked according to a ranking scheme based on said optical information of food to be prepared and said meta-information, said ranking being performed according to a probability that the respective estimated food type matches the food received within the cavity.

9. Food preparation entity according to claim 8, wherein the list of food types is sorted according to the probability that the respective estimated food type matches the food received within the cavity.

10. Food preparation entity according to claim 1, wherein multiple pieces of meta-information are combined for selecting one or more food types out of the subset of available food types.

11. Food preparation entity according to claim 1, wherein a deep learning algorithm is used for selecting said one or more food types.

12. Food preparation entity according to claim 1, wherein one or more food preparation programs or one or more food preparation parameters are suggested for the selected one or more food types.

13. Food preparation entity according to claim 1, the food preparation entity being adapted to communicate with one or more appliances in order to receive information from said one or more appliances, the food preparation entity being further adapted to process said received information for defining one or more food preparation process parameters.

14. Method for automatically selecting one or more food types in a food preparation entity, the food preparation entity comprising a cavity for receiving food to be prepared and an image recognition system for capturing optical information of food to be prepared, the method comprising the steps of:

capturing optical information of food received within the cavity;

performing a food preselection based on the captured optical information in order to determine a subset of available food types;

receiving meta-information based on the captured optical information, said meta-information comprising one or more of the following: geographical information, user information, temporal information; and selecting via a machine-learning algorithm one or more types of food out of the subset of available food types based on said captured optical information and said meta information.

15. A method for cooking food in an oven having a cooking cavity, comprising:

receiving a food to be cooked in said cooking cavity;

capturing optical information from the received food via an image-recognition system;

a processor of said oven performing a preselection based on said captured optical information in order to determine, from a list of available food types, a subset of available food types for the received food;

said processor thereafter selecting via a machine-learning algorithm, from said subset of available food types one or more probable food types for said received food based on meta-information, said meta-information comprising at least one of:

geographical information, information concerning an identity of a current user of the oven, or temporal information; and suggesting to the user a food preparation program or parameter for the selected one or more probable food types.

16. The method according to claim 15, further comprising associating each food type in the subset of available food types with weighting factor depending on said geographical information, and providing a list of said probable food types on a graphical user interface of said oven wherein entries in said list are ranked according to respective probabilities that the received food conforms to each respective food-type entry in the list based on said captured optical information and said meta-information, wherein said probabilities adapt over time based on said learning algorithm in order to predict future data concerning the received food item based on information from previous data.

17. The food preparation entity according to claim 1, said user information comprising an identity of a current user thereof.

18. The food preparation entity according to claim 1, said machine-learning algorithm being adapted to learn from previous data and to predict future data based on the previous data.

* * * * *